United States Patent [19]

Hendrick

[11] 3,954,140

[45] May 4, 1976

[54] RECOVERY OF HYDROCARBONS BY IN SITU THERMAL EXTRACTION

[76] Inventor: Robert P. Hendrick, 801 "D" Ave., Lawton, Okla. 73501

[22] Filed: Aug. 13, 1975

[21] Appl. No.: 604,299

[52] U.S. Cl. ..... 166/272; 166/60

[51] Int. Cl.[2] ..... E21B 43/24

[58] Field of Search ..... 166/302, 303, 272, 245, 166/256, 258, 259, 257, 50, 60, 57

[56] References Cited

UNITED STATES PATENTS

| | | | |
|---|---|---|---|
| 1,816,260 | 7/1931 | Lee | 166/50 X |
| 2,497,868 | 2/1950 | Dalin | 166/256 |
| 2,634,961 | 4/1953 | Ljungstrom | 166/302 |
| 2,788,956 | 4/1957 | Pevere et al. | 166/259 |
| 2,923,535 | 2/1960 | Ljungstrom | 166/256 |
| 3,601,193 | 8/1971 | Grady | 166/259 |

*Primary Examiner*—Stephen J. Novosad

[57] ABSTRACT

Hydrocarbons are recovered from a subterranean formation by providing a plurality of generally horizontal boreholes in the formation. The boreholes are vertically spaced across the thickness of the formation and extend from the top to the bottom thereof. Selected boreholes are heated by means of an external source to drive off hot hydrocarbon gases. The hot gases are fed to selected, unheated boreholes to effect a preheating of the selected boreholes and to cool the hot gases prior to their recovery from the formation.

6 Claims, 5 Drawing Figures

FIG. 3
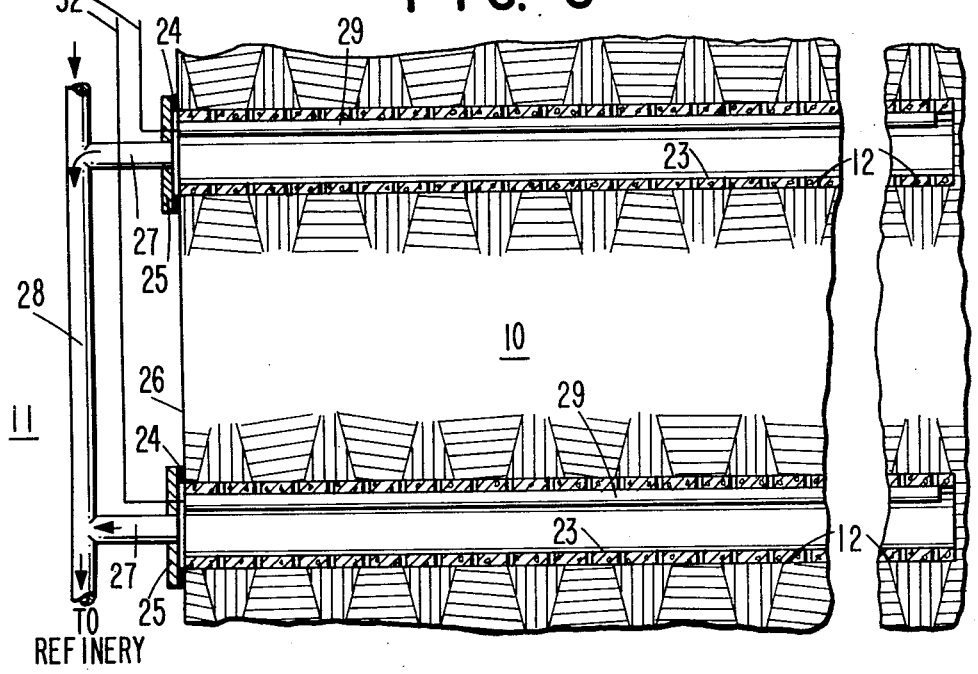
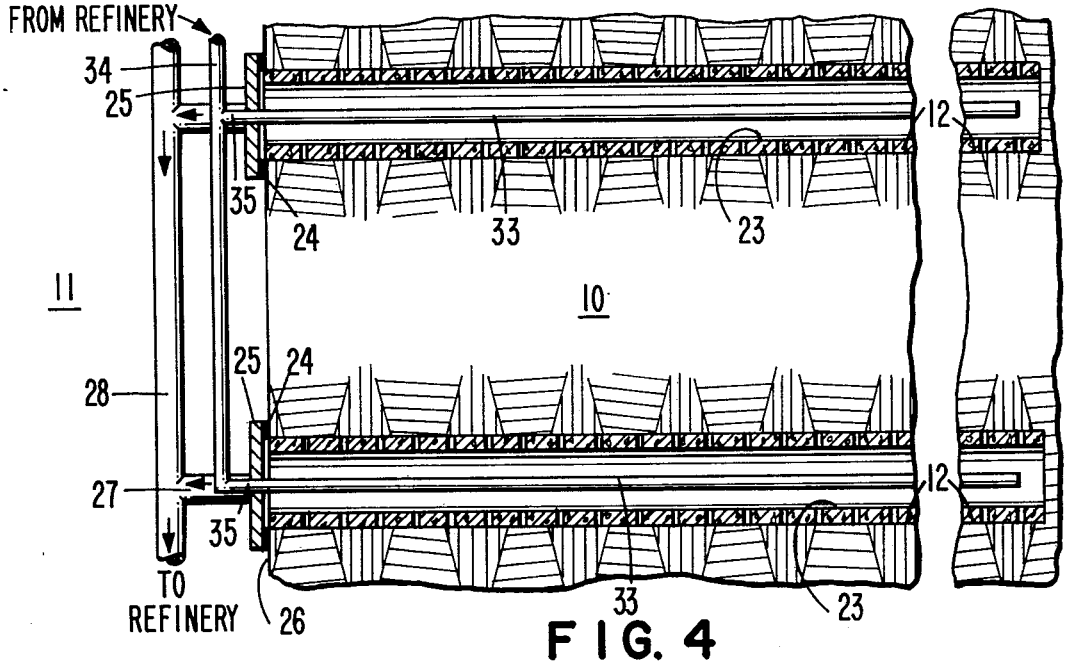
FIG. 4
FIG. 5
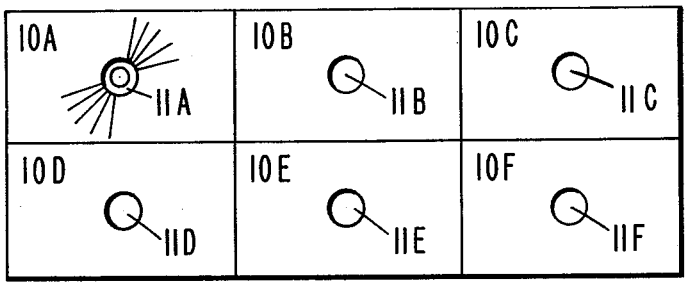

RECOVERY OF HYDROCARBONS BY IN SITU THERMAL EXTRACTION

BACKGROUND OF THE INVENTION

1. Field of the Invention

This invention relates to the recovery of hydrocarbons in situ and, more particularly, to the recovery of hydrocarbons in situ by thermal extraction of hydrocarbon-containing subterranean formations, in conjunction with the recovery of heat from the extracted hydrocarbons.

2. Description of the Prior Art

Large deposits of coal and oil in the form of oil shale are found in various sections of the United States, particularly in Colorado and surrounding states and Canada. Various methods of gasifying the coal and recovering the oil from these shale deposits have been proposed. However, the principal difficulty with these methods is their high cost which renders the recovered products too expensive to compete with hydrocarbon gases and petroleum crudes recovered by more convention methods. For example, mining the coal or oil shale and removing the hydrocarbon therefrom by above-ground retorting in furnaces presents disposal and pollution problems, and also requires the use of extremely large quantities of coolant to reduce the temperature of the recovered products so that they can be marketed. Similarly, in situ retorting of the coal or oil shale to recover the hydrocarbons contained therein is made difficult because of the nonpermeable nature of the coal and oil shale and because of the massive amount of heat necessary to recover the hydrocarbon products. Nonetheless, the art discloses various means for improving the hydrocarbon recovery in situ from coal and oil shale such as described in U.S. Pat. Nos. 3,001,776 or 3,273,649 or 3,349,848 or 3,481,398. Although these references are directed to advancements of the art, they generally require rubblization techniques such as by means of explosive devices, e.g., nuclear energy, as well as the use of massive amounts of coolant and expensive heat exchange facilities.

OBJECTS OF THE INVENTION

In view of the foregoing, it is an object of this invention to provide an improved method for recovering hydrocarbons in situ from coal and oil shale formations which avoids the difficulties and expense of prior art techniques.

It is another object of the proposed invention to recover hydrocarbons from a coal or oil shale formation by heating the coal or oil shale formation in situ, whereafter the recovered hydrocarbons are passed into heat exchange relation with relatively cooler areas of the formation to cool the hydrocarbons before they are recovered above ground.

It is yet another object of the proposed invention to minimize the amount of heat energy that must be injected from an above ground source into a coal or oil shale formation to drive hydrocarbons therefrom by utilizing the heat contained in the recovered hydrocarbons to preheat relatively cooler portions of the formation.

Yet another object is to cool at least partially the hydrocarbons recovered by in situ thermal extraction of coal or oil shale by passing the hydrocarbons into heat exchange contact with relatively cooler portions of the formation prior to removing the hydrocarbons therefrom.

It is a further object to recover hydrocarbons from coal or oil shale formation by excavating a plurality of elongated, generally horizontal boreholes into the formation, injecting heat energy into selected boreholes from an external source to drive hot hydrocarbons from the externally heated boreholes, and passing the resultant hot hydrocarbons into heat exchange relation with relatively cooler boreholes to preheat the cooler boreholes and to cool the hydrocarbons.

Still another object of the invention is to recover hydrocarbons from a coal or oil shale formation in situ and to refine at least partially the hydrocarbons while they are still within the formation.

Another object is to excavate a vertical shaft and a plurality of generally horizontal boreholes into a coal or oil shale formation, to extract hydrocarbons from selected boreholes by means of an external heating element, and to utilize the heat energy in the extracted hydrocarbons to heat the formation adjacent selected others of the boreholes.

Other objects and advantages of the invention will be apparent from the following description.

SUMMARY OF THE INVENTION

The present invention is directed to the recovery of hydrocarbons from a subterranean coal or oil shale formation wherein a plurality of elongated boreholes is formed in the formation and wherein heat energy is injected into the boreholes to convert the coal or oil shale and drive hot hydrocarbons therefrom. The boreholes may be arranged in a variety of patterns within a given coal or oil shale formation, but it is essential that the respective boreholes be arranged for fluid communication between each other so that the fluids in any given borehole may be transferred to other boreholes in a selective manner to facilitate a selective heat exchange within the various zones of the formation. Thus, for example, the boreholes may be arranged in vertical columns and/or horizontal rows into the face of an exposed coal or oil shale formation, or they may be drilled into a formation about the periphery of a generally vertical well bore extending from the ground downward through the formation. In the latter case, the well bore or central shaft is dug through the formation and is made wide enough to facilitate the drilling of the elongated boreholes and to accommodate all of the necessary process equipment. The central shaft may comprise any convenient cross-sectional configuration, and may be square, rectangular or circular, in cross-section, with a circular cross-section of about 150–200 feet in diameter being typical.

The depth of the central shaft is dependent upon the depth of the particular formation and whether the crude products will be partially refined below the ground, as will be described more fully hereinafter. However, the depth is usually a minimum of about 300 feet.

The coal or oil shale material that is removed from the ground when excavating the central shaft is collected and processed in a conventional manner for the recovery of hydrocarbon products. The spoil or spent material is then reserved for backfill.

After the central shaft is excavated, the above mentioned boreholes are drilled into the formation. As indicated, the boreholes may be arranged in a variety of patterns depending, in part, upon the cross sectional configuration of the central shaft, but depending also upon the size, shape and heat transfer characteristics of a given formation. In this latter regard, one of the key considerations in selecting a pattern for the boreholes is to recover as much of the recoverable hydrocarbons in the formation, while minimizing the expenditures for heat injection, borehole drilling and heat exchange equipment.

The length of the boreholes also depends upon the characteristics of the formation involved, as does the diameter thereof. However, the boreholes are typically from about 1500 to about 9000 feet in length, and from about 9 to about 11 inches in diameter. In addition, the boreholes are usually drilled at a slightly upward incline such that they slope upwardly from about 2.4 to about 3.5 inches per 100 feet of length.

In a typical embodiment of the present invention, the central shaft might comprise a cylindrical well having a diameter of about 200 feet and a depth of about 300 feet, and having a plurality of boreholes radiating from the vertical axis of the shaft into the formation.

The spacing of the boreholes around the periphery of the central shaft might be substantially uniform with respect to the number of holes in a given horizontal plane or vertical plane. However, it is preferable that the boreholes be drilled in a pattern which is more closely spaced at the top of the hydrocarbon-containing formation and more scattered toward the bottom of the formation. For example, the boreholes may be drilled radially every 3° around the periphery of the central shaft at the top of the formation and only every 12° at the bottom, the spacing gradually increasing from top to bottom. The boreholes are generally drilled in spaced horizontal layers with each layer being spaced about 2–3 feet below the next superadjacent layer. In addition, the radial pattern of each subjacent layer of boreholes is generally offset relative the next superadjacent layer. Thus, if the boreholes in the uppermost layer are spaced every 3° around the periphery of the central shaft, the boreholes in the second uppermost layer would be spaced slightly greater that 3° apart and would be offset approximately 1.5° relative to the boreholes in the uppermost layer.

Each of the boreholes is provided with a perforated or porous casing for receiving gases from the formation. The casings may comprise aluminum alloys or other suitable material, and are disposed within the entire length of each borehole. Each porous casing is suitably secured to the peripheral wall of the central shaft and each is capped or otherwise closed-off to prevent unrestricted fluid communication from the interior of the casing to the central shaft.

As will be discussed more fully hereinbelow, the end cap or closure means of each porous casing is drilled and fitted for insertion of a heating element for heating the formation and driving hot gases therefrom. The end caps are also drilled and fitted with a suction line for removing from the interior of the porous casings the hot gases generated by the heating element. In addition, each of the end caps is drilled and fitted for inserting an imperforate casing within each porous casing for the introduction of gases or other heat exchange fluids therein.

In one embodiment, a refining section comprising one or more heat exchangers, and suitable compressors and pumps similar to those employed in a conventional petroleum refinery, is located on the floor of the central shaft. The purpose of the refining section is to receive from the suction lines the hot gases that are recovered from the formation and to separate the gases into various product fractions as far as possible using only the heat available in the recovered gases.

A roof structure or rigid top is provided over the refining section and across the central shaft at a predetermined depth within the central shaft above the uppermost layer of boreholes. The roof may comprise any suitable structure which can prevent free fluid communication from the central shaft to the atmosphere and which can withstand the gas pressures that will be developed within the central shaft. Preferably the roof should also be sufficiently strong to support a bed of spent or processed material, which bed would provide heat insulation for the central shaft. Of course, piping to and from the refining section and appropriate connections to and from the herein described heating elements would be installed through the roof structure.

As indicated above, a heating element is inserted in each porous casing to heat the formation and drive volatile hydrocarbons therefrom. The heating elements, which may comprise conventional resistance or inductance heaters, are inserted in all of the drilled boreholes, but during the initial stages of the hydrocarbon recovery only those heaters in the boreholes near the top of the formation are energized. Thus, during the initial stages of recovery, the heating elements are used to heat the formation adjacent the upper boreholes to a first predetermined temperature depending upon the specific formation involved and upon the volatility of the hydrocarbons sought to be recovered. For example, for a typical oil shale formation, the heating elements are controlled by conventional sensing and control means to heat formation adjacent the upper boreholes to a temperature in excess of about 600° F., e.g., about 550°–750° F. The heated portions of the formation thus evolve hot hydrocarbon gases which are passed through the porous casings. with the aid of one or more suitable compressors the hot gases are withdrawn from the porous casings through the suction lines and fed into the refining section. Within the refining section the hot gases are cooled by conventional heat exchange techniques employing partially cooled product gases and condensates as the heat exchange medium and, as far as possible, are separated into various product fractions. At one or more locations within the refining section, the hot gases are forced into the porous casings of one or more of the lower, relatively cooler boreholes by means of the imperforate casings disposed therein. The hot gases tend to expand and fill the porous casings and to undergo heat exchange with the adjacent formation. This expansion and heat exchange cools the gases, while simultaneously driving the more volatile hydrocarbons from the adjacent formation. The cooled gases and volatile hydrocarbons are withdrawn through the suction lines in the end caps of the porous casings and are returned to the refining section for further heat exchange and product separation. The products separated from the cooled gases are piped through the roof over the central shaft to storage, transmission or, if desired, to further refining. Similarly, the hydrocarbon gases which are driven from the formation into the central shaft are recovered through suitable means connected to the roof structure and are refined above ground by conventional means.

As the formation adjacent the uppermost holes becomes devoid of hydrocarbons that can be driven off at the first predetermined temperature, the heating elements in the next lower boreholes are energized. This process is continued until all of the holes are heated to the first predetermined temperature. At this point, the temperature front is reversed with the temperature in the bottom boreholes being increased to a second predetermined temperature to obtain heavier hydrocarbons and any remaining lighter hydrocarbons. The increased temperature is then moved upwardly within the formation by heating each successive layer of boreholes to the second predetermined temperature by means of their respective heating elements and by selectively passing the hot gases that are driven from the bottom boreholes through the refining section and upper boreholes.

In one embodiment, the boreholes are re-drilled after all of the holes have been heated to the first predetermined temperature to remove spent portions of the formation. In this embodiment, the spent material that is removed from the boreholes may be left in the bottom of the central shaft.

In another embodiment of the invention, the refining section is disposed at a ground level site rather than at the bottom of the central shaft. In this case, there is no product separation within the formation, but the hot gases driven from the formation adjacent the externally heated boreholes are still forced into selected cooler boreholes to cool the gases before they are passed to the above-ground refinery and to preheat the relatively cooler portions of the formation.

In still another embodiment, the hydrocarbon-containing formation may be divided into a plurality of plots or sections with each plot being provided with its own central shaft and elongated boreholes.

BRIEF DESCRIPTION OF THE DRAWINGS

FIG. 3 is a partial, schematic vertical sectional view illustrating the manner in which certain radiating boreholes are heated by an external heating element and further illustrating the manner in which thermally extracted hydrocarbon gases are transferred to the refining section.

FIG. 4 is a partial, schematic vertical sectional view illustrating the manner in which certain radiating boreholes are preheated by thermally extracted hydrocarbon gases which are transmitted to the boreholes from the externally heated boreholes and from the refining section.

FIG. 5 is a schematic horizontal sectional view illustrating an embodiment of the invention wherein the hydrocarbon-containing formation is divided into six sections, each section being provided with a central shaft and a plurality of radiating boreholes.

DESCRIPTION OF A PREFERRED EMBODIMENT

Figure 1:
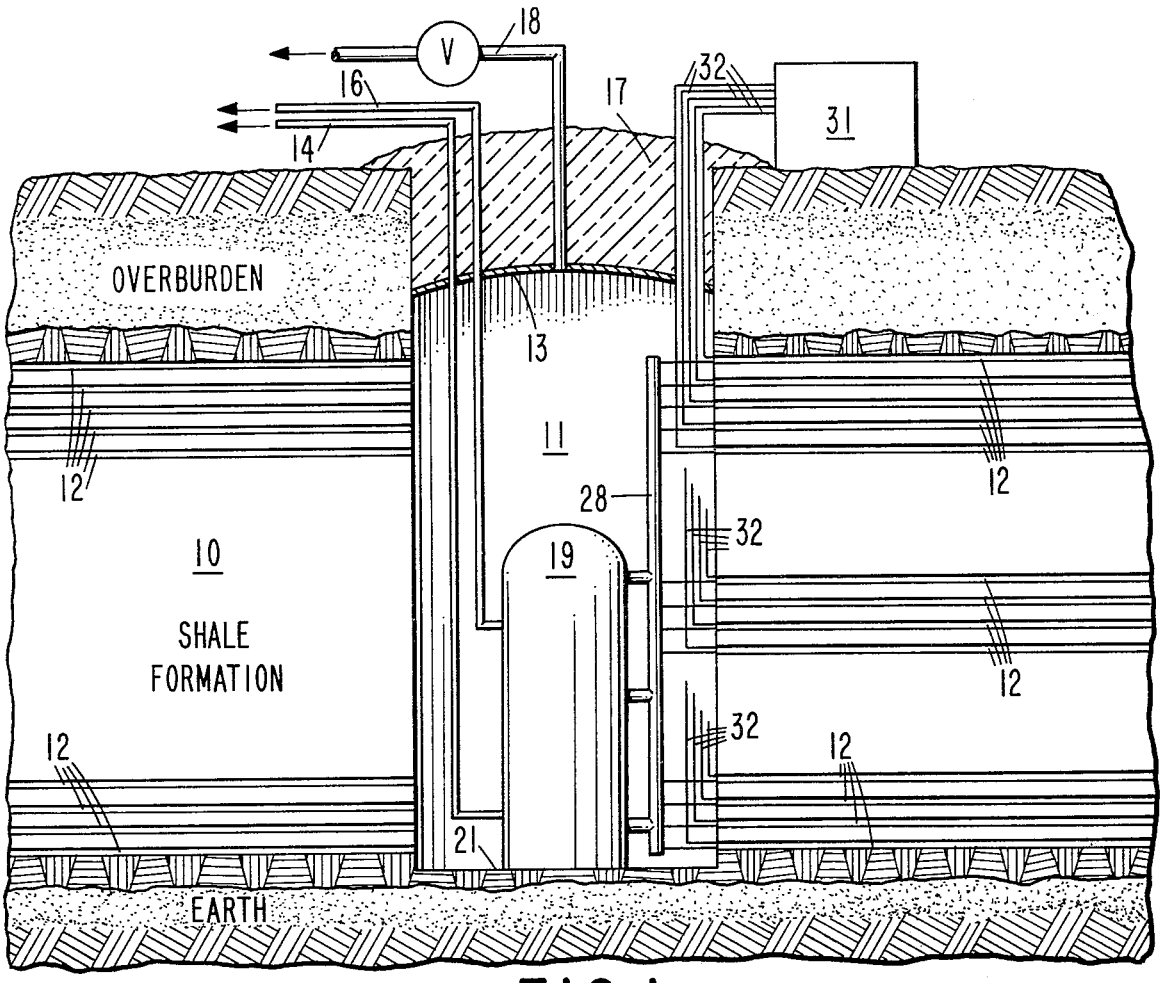
FIG. 1 is a schematic vertical sectional view, with portions removed for the sake of clarity, of an embodiment of the invention showing a hydrocarbon-containing formation having a central access shaft, a plurality of generally horizontal boreholes radiating therefrom, means for heating the formation adjacent the boreholes and a refining section for separating the recovered hydrocarbons.

Referring to FIG. 1 there is shown a subterranean hydrocarbon-containing formation 10. A central shaft 11 and a plurality of boreholes 12 are shown extending into the formation. The central shaft 11 is illustrated as being provided with a ceiling or roof structure 13 through which suitable piping 14 and 16 are provided for transmitting hydrocarbon products and gases to storage, refining or the like.

The roof structure 13 is covered with spent shale 17 to provide thermal insulation for the central shaft, and is provided with a suitably valved conduit 18 for controlling the pressure within the central shaft and for transmitting hydrocarbon gases that are driven into the central shaft to suitable above ground refining facilities (not shown).

A refining section comprising a conventional plate-type fractionator 19 is illustrated as being mounted on the floor 21 of the central shaft. As discussed the fractionator 19 receives hot and partially cooled hydrocarbon gases from the relatively hotter and cooler boreholes, respectively, and effects the separation of the hydrocarbon gases in various boiling point fractions which are passed through the roof 13 through lines 14 and 16.

Figure 2:
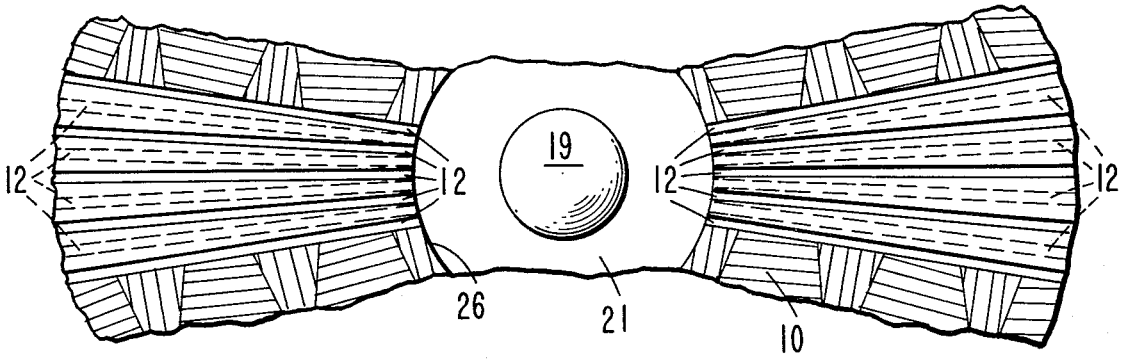
FIG. 2 is a schematic horizontal sectional view, with portions removed, illustrating the pattern of the boreholes radiating from the central shaft of FIG. 1.

The boreholes 12 are spaced about every 3° at the top of the formation 10 and about every 12° at the bottom, with each level of holes being 2.5 feet apart and being offset relative to the level immediately thereabove (FIG. 2). The boreholes are 1500 feet long and slope upwardly at a ratio of 1:500.

The boreholes 12 are illustrated as having porous casings 23 (FIG. 3) cemented or otherwise secured in place by a suitable sealant 24 at the wall 26 of the central shaft 11. Although only two boreholes are illustrated in FIG. 2, obviously all of the boreholes radiating from the central shaft are provided with porous casings 23. An end cap 25 is cemented or otherwise secured to the end of each casing 23 to prevent unrestricted fluid communication between the respective boreholes and the central shaft, and each borehole is fitted with a suction line 27 which establishes fluid communication between the boreholes and the fractionator 19 through a suitable compressor (not shown) and conduit 28. Each borehole 12 is also illustrated as being fitted with an electric heating element 29 which is connected to a source 31 of electrical energy by means of a suitable electric conduit 32 passing through the roof structure 13. Each heating element 29 is provided with suitable temperature sensors and controls (not shown) so that the temperature within a given borehole can be adjusted to a predetermined level. As illustrated in FIG. 4, each of the boreholes 12 is also fitted with an imperforate casing 33 that fits within the porous casing 23 for the introduction of hot hydrocarbon gases into the respective boreholes from the refinery section. The hot hydrocarbon gases are fed to the imperforate casings 33 by means of a suitable compressor (not shown) and conduits 34 and 35. Suitably controlled valves (not shown) are provided on the conduits 27 and 35 so that the flow of gases into and out of respective boreholes can be controlled during the hydrocarbon extraction process.

To effect the hydrocarbon extraction, the valves in lines 27 and 35 are adjusted so that the suction lines 27 and 28 are open, and the heat exchange feed lines 34 and 35 are open only near the bottom of the formation. The heating elements 29 at the top two or three levels of boreholes are then actuated until the temperature in that area of the formation reaches a first predetermined level. This level would be in excess of about 600° F., e.g., about 575°–725° F. for a typical oil shale formation. The hot hydrocarbon gases which are driven from the heated portions of the formation pass through the porous casings 23 and, as discussed above, are drawn through the suction line 28 to the fractionator 19. In the fractionator 19, the hot gases from heated boreholes are contacted with cooler gases from unheated boreholes or with cool heat exchange fluids fed to the fractionator from a source on the ground. The products from the fractionator, which comprise various selected cuts such as heating oil, gasoline, etc. are forced to the surface through the roof structure 13 in conduits 14 and 16.

The partially cooled gases which pass through the fractionator 19 are used to preheat the lower, cooler boreholes. This is accomplished by compressing the gases and forcing them through the imperforate casings 33 in the lower levels of boreholes. The compressed gases tend to expand in the boreholes and to undergo direct contact heat exchange with the adjacent portions of the formation. This expansion and heat exchange further cools the gases, while simultaneously heating the formation and driving some of the more volatiles therefrom. The cooled gases, and any liquids formed during the cooling thereof, together with the volatiles from the lower portions of the formation are then returned to the fractionator 19 where they undergo further separation and heat exchange.

As the amount of hot gases driven from the upper boreholes diminishes to an uneconomic level, the heating elements in the next lower levels are energized and the process is continued until all of the boreholes have been heated to the first predetermined temperature. At this point, the temperature in the lower levels of boreholes is increased to a second higher temperature, e.g., about 1200° F. for a typical oil shale formation, and the process is reversed until each higher level of boreholes has been heated to the second higher temperature. Of course, the valves in conduits 27 and 35 will be adjusted when necessary to ensure the proper flow of gases into and out of the respective boreholes. It will be appreciated that the production of the hydrocarbon products may be aided by downhole pumping and compressing means, or restricted to the extent necessary to maintain the selected pressure within a given formation.

Although it is not necessary, it may be desirable to enlarge the diameter of the boreholes 12 and thereby remove partially sloughed material therefrom before increasing the temperature of the boreholes to the second higher level. If this is done, the sloughed material may be left at the bottom of the central shaft.

As indicated above, the length of the boreholes 12 may vary over wide limits. However, in cases where shorter lengths are desired, for example, lengths in the range of about 1500 to 3000 feet, the formation may be divided in sections or zones 10A–10F (FIG. 5). In this manner, each zone may be provided with its own central shaft from which relatively short boreholes may be drilled into the formation. This technique would provide flexibility to the production system and would obviate any difficulties associated with the use of extremely long boreholes.

Whereas the invention has been described in connection with the recovery of hydrocarbons from subterranean oil shale and coal formations, it is within the scope of this invention to employ the system described herein to retort in situ any subterranean strata which will evolve a gaseous product when subjected to the injection of thermal energy.

What is claimed is:

1. A method of producing hydrocarbons from a hydrocarbon-containing subterranean formation, comprising the steps of:

a. providing a plurality of boreholes extending generally horizontally from a central dug access area into the hydrocarbon-containing formation, said boreholes being provided in vertically spaced relation from top to the bottom of the formation;

b. selectively heating the boreholes adjacent the top of the formation to a first predetermined temperature which is sufficiently high to drive hydrocarbons from the formation in the form of hot gases;

c. selectively establishing fluid communication between the boreholes adjacent the top of the formation and predetermined lower boreholes by external pipe or conduit access;

d. passing said hot gases from the heated boreholes adjacent the top of the formation to said predetermined lower boreholes to effect heat exchange between said hot gases and the areas of the formation adjacent said predetermined lower boreholes, thus cooling said hot gases and preheating the areas of the formation adjacent said lower boreholes;

e. serially heating to said first predetermined temperature successively lower boreholes relative to the top of the formation to drive hot hydrocarbon gases from the formation adjacent said successively lower boreholes, said predetermined temperature moving downwardly through the formation as successively lower boreholes are heated;

f. serially and selectively establishing fluid communication between the successively heated lower boreholes and selected unheated boreholes to exchange heat from the generated hot hydrocarbon gases to the relatively cooler areas of the formation adjacent said unheated boreholes;

g. continuing the serial heating of lower boreholes until all of said boreholes have been heated to said first predetermined temperature; and h. recovering the hydrocarbons driven from the formation by means of an in-situ heat exchange-refinery apparatus.

2. The method of claim 1, further comprising the steps of:

a. selectively heating the boreholes adjacent the bottom of the formation after all of said boreholes have been heated to said first predetermined temperature to a second predetermined temperature which is higher than said first predetermined temperature, thereby driving relatively heavy hydrocarbon gases therefrom;

b. selectively establishing fluid communication between said boreholes adjacent the bottom of the formation and predetermined higher boreholes;

c. passing said heavy hydrocarbon gases from the heated boreholes adjacent the bottom of the formation to said predetermined higher boreholes to exchange heat from the heavy hydrocarbons to the areas of the formation adjacent said predetermined higher boreholes and to partially cool said heavy hydrocarbons;

d. serially and selectively heating successively higher boreholes to said second predetermined temperature to drive relatively heavy hydrocarbons from the areas of the formation adjacent said successively higher boreholes, said second predetermined temperature moving upwardly through the formation;

e. serially establishing fluid communication between the successively heated higher boreholes and predetermined boreholes in the upper portion of the formation to exchange heat from the generated heavy hydrocarbons to the relatively cooler areas of the formation;

f. continuing the serial heating of upper boreholes until all of said boreholes have been heated to said second predetermined temperature; and g. recovering the heavy hydrocarbons.

3. The method of claim 1, wherein the hot gases driven from the formation adjacent heated boreholes are passed to heat exchange means and heat exchanged with the partially cooled gases recovered from the unheated boreholes prior to the step of recovering the hydrocarbons from the formation.

4. A method of producing hydrocarbons from a subterranean hydrocarbon-containing formation, which comprises the steps of:

a. providing a substantially vertical central shaft extending into the hydrocarbon-containing formation, said shaft having a vertical axis;

b. providing a plurality of boreholes extending into the formation in a generally radial direction relative to said vertical axis, said boreholes being provided in vertically spaced layers around the periphery of said central shaft, said vertically spaced layers extending downwardly from the top to the bottom of the formation;

c. providing means for selectively heating said boreholes, said means being provided with energy from a source remote from said shaft and said boreholes;

d. providing heat exchange means within said shaft said means including means for selectively establishing fluid communication between said boreholes;

e. selectively energizing said heating means such that the temperature of the hydrocarbon containing formation adjacent the uppermost layer of boreholes is raised to a first predetermined temperature, sufficient to drive hydrocarbons from the heated formation in the form of hot gases;

f. selectively establishing fluid communication between said uppermost layer of boreholes and predetermined lower boreholes to exchange heat from the hot hydrocarbon gases to the portions of the formation adjacent said predetermined lower boreholes and to partially cool said hot hydrocarbon gases;

g. serially energizing the heating means to heat successively lower layers of said boreholes to said first predetermined temperature and to drive hot hydrocarbon gases from the adjacent formation, said temperature range moving downwardly through the formation as the heating means is energized to heat each successive lower layer of boreholes;

h. serially and selectively establishing fluid communication between the successively heated layers of boreholes and selected unheated boreholes to exchange heat from the generated hot hydrocarbon gases to the relatively cooler areas of the formation adjacent said unheated boreholes;

i. continuing the serial heating of lower layers of boreholes until all of said boreholes have been heated to said first predetermined temperature; and j. recovering the hydrocarbons driven from the formation.

5. The method of claim 4, wherein the hot gases driven from the formation adjacent heated boreholes are passed to said heat exchange means and heat exchanged with the partially cooled gases recovered from the unheated boreholes prior to recovering the hydrocarbons from the formation.

6. The method of claim 4, further comprising the steps of:

a. selectively energizing the heating means after all of said boreholes have been heated to said first predetermined temperature to increase the temperature of the formation adjacent said lowermost level of boreholes to a second predetermined temperature sufficient to drive relatively heavy hydrocarbons from the heated formation;

b. selectively establishing fluid communication between said lowermost layer of boreholes and predetermined upper boreholes to exchange heat from the heavy hydrocarbons to the formation adjacent said predetermined upper boreholes and to partially cool said heavy hydrocarbons;

c. serially energizing the heating means to heat successively higher layers of boreholes to said second predetermined temperature and to drive relatively heavy hydrocarbons from the adjacent formation, the increased temperature moving upwardly through the formation;

d. serially establishing fluid communication between the successively heated layers of boreholes and selected boreholes in the upper portion of the formation to exchange heat from the generated heavy hydrocarbons to the relatively cooler areas of the formation;

e. continuing the serial heating of upper boreholes until all of said boreholes have been heated to said second predetermined temperature; and f. recovering the heavy hydrocarbons.

* * * * *